United States Patent [19]

Apte

[11] 4,361,015

[45] Nov. 30, 1982

[54] HEAT PUMP

[76] Inventor: Anand J. Apte, 4904 Cushing Dr., Kensington, Md. 20795

[21] Appl. No.: 223,270

[22] Filed: Jan. 8, 1981

[51] Int. Cl.[3] ..... F25B 27/02

[52] U.S. Cl. ..... 62/238.4; 62/500

[58] Field of Search ..... 60/671; 62/500, 501, 62/238.4, 467; 417/348, 406; 415/143; 416/171

[56] References Cited

U.S. PATENT DOCUMENTS 1,871,244 8/1932 Steuart ..... 62/500 X 2,238,502 4/1941 Muir et al. ..... 416/171

3,259,176 7/1966 Rice et al. ..... 62/238.4

3,276,226 10/1966 Osborne ..... 62/500 X

*Primary Examiner*—Lloyd L. King

*Attorney, Agent, or Firm*—Boris Haskell

[57] ABSTRACT

A single working fluid heat pump system having a turbocompressor with a first fluid input for the turbine and a second fluid input for the compressor, and a single output volute or mixing chamber for combining the working fluid output flows of the turbine and the compressor. The system provides for higher efficiency than single fluid systems whose turbine and compressor are provided with separate output volutes.

7 Claims, 4 Drawing Figures

HEAT PUMP

BACKGROUND AND SUMMARY OF INVENTION

The present invention relates to heat pump systems, and particularly to the utilization of a unitary or integrated fluid motor and compressor, such as a turbine and compressor, in a single fluid system. Heat pump systems are well known, particularly for space heating and cooling, and the present invention is described herein in that context. However, it should be understood that the invention is also applicable to other environments, such as vapor compression evaporators.

The present invention is described herein with reference to a combined turbine and compressor, wherein the fluid output flow from the turbine and the compressor are combined into a single mixing chamber or volute. By means of this invention the efficiency of heat pump systems is significantly improved. Although it is currently envisioned that a turbine/compressor unit is the preferred form of practicing the invention, it is not intended that the invention be viewed as limited thereto.

Single fluid heat pump systems are known in the prior art, as exemplified by the U.S. Pat. Nos. to N. C. Rice, et al. 3,259,176 and A. B. Steuart 1,871,244. The working fluid for such systems may include a fluorocarbon refrigerant, as suggested in the Rice patent, or may be water, ethanol, methanol, or the like, or mixtures thereof. These systems include: one circulating subsystem wherein liquid working fluid is fed to a boiler and vaporized under pressure, expanded through a turbine, condensed back to a liquid in a condenser, and cycled back to the boiler; and a second circulating subsystem wherein said liquid working fluid is fed to an evaporator where it is expanded to a vapor, compressed in a compressor driven by said turbine, condensed back to a liquid in the same condenser as stated above, and recycled to the evaporator. There are thus provided two parallel subsystems, wherein the turbine of one, drives the compressor of the other, and the outputs of the turbine and compressor are combined into a single flow feeding into a single condenser. In the prior art systems, the turbine and the compressor are separate and individual units possessing their respective individual input and output chambers or volutes, even though they have an interconnecting drive shaft, and even though they may be combined within a single casing or housing, as suggested in said Steuart patent.

In accordance with the present invention, the turbine/compressor has a single rotor carrying two sets of blades, one set for the compressor and one set for the turbine, each set of blades having its separate input chamber or volute. However, the outputs for the two sets of blades feed into a single output mixing chamber or volute. It is through the provision of this single output of mixing chamber that the improved efficiency of the present invention is obtained. Whereas the prior U.S. Pat. No. 2,238,502 to Muir discloses a turbine/-pump combination wherein the output of the turbine and the output of the pump are combined in a single chamber, there is no teaching or suggestion that such a unit would increase the efficiency of a single fluid heat pump system of the type stated above.

Accordingly, it is one object of the present invention to provide a heat pump system having improved efficiency.

Another object of the present invention is to provide a single fluid heat pump system having improved efficiency.

Still another object of the present invention is to provide a combined turbine/comressor for improving the efficiency of a single fluid heat pump system.

And a further object of the present invention is to provide a combined turbine/compressor having a single output mixing chamber or volute for improving the efficiency of a single fluid heat pump system.

Other objects and advantages of the invention will become apparent to those skilled in the art from a consideration of the detailed description of one embodiment of the invention presented hereinafter to facilitate a complete understanding of the invention. It is understood, however, that the specific embodiment disclosed is only illustrative, and other embodiments will be apparent to those skilled in the art.

DESCRIPTION OF THE DRAWINGS

The following detailed description of the invention is had in conjunction with the accompanying drawings, in which like reference characters refer to like or corresponding parts, and wherein.

DETAILED DESCRIPTION

Figure 1:
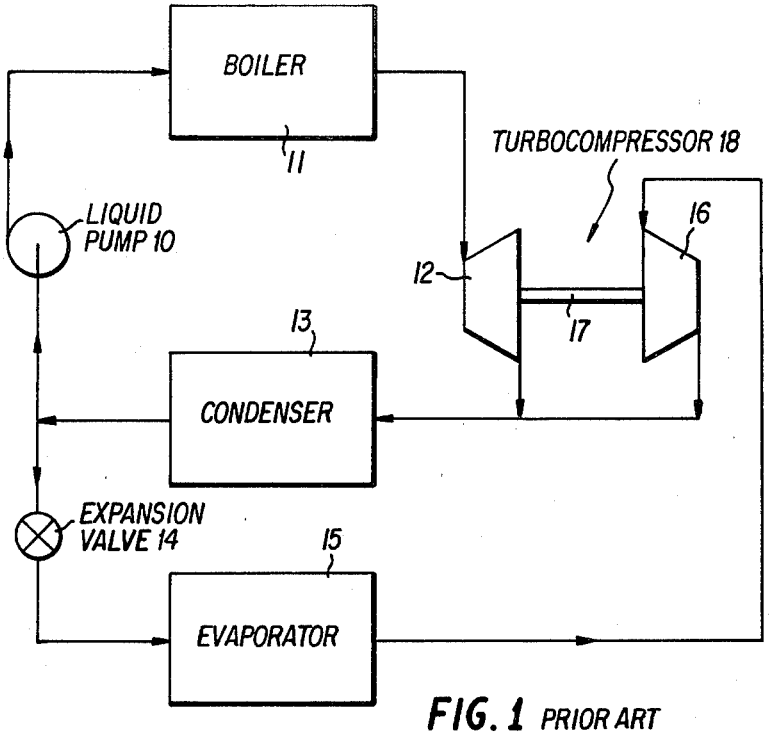
FIG. 1 PRIOR ART
FIG. 1 is a schematic block diagram of a single fluid heat pump system as taught in the prior art.
Figure 2:
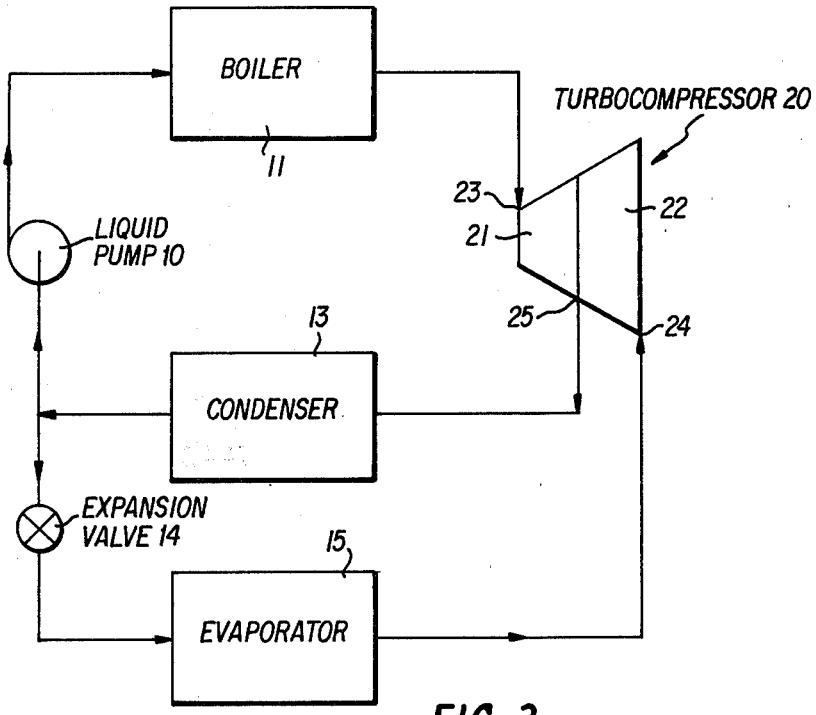
FIG. 2 is a schematic block diagram of a single fluid heat pump system in accordance with the present invention.

A known prior art single fluid heat pump system, such as described in the aforesaid Rice U.S. Pat. No. 3,259,176, is illustrated in FIG. 1, and the improvement of the present invention thereover is illustrated in FIG. 2. In both systems a working fluid such as a fluorocarbon refrigerant, or water, ethanol, methanol or a mixture thereof, is used. In one subsystem, the fluid is in a liquid state when it enters the liquid pump 10, it is vaporized under pressure at the boiler 11, expands through the turbine of the turbocompressor to drive the compressor, and is then condensed back to a liquid at condenser 13. In the other subsystem, the fluid in a liquid state passes through the expansion valve 14 and is vaporized in the evaporator 15, it is then compressed in the compressor of the turbocompressor and condensed back to a fluid in condenser 13. As in fully understood, heat is given up from the fluid into the ambient environment at the condenser 13, and heat is extracted from the ambient environment at the evaporator 15, when the system is used for space heating and cooling.

In the prior art teachings of FIG. 1, the turbocompressor 18 comprises two essentially separate units, turbine 12 and compressor 16, with the turbine driving the compressor by means of drive shaft 17. Turbine 12 and compressor 16 each has its own input and output chambers or volutes, although the outputs of both units are combined into a single duct as the input to the condenser 13.

In accordance with the present invention, as shown in FIG. 2, the turbocompressor 20 comprises an integral turbine 21 and compressor 22. The pressurized fluid vapor from boiler 11 enters the turbine 21 through volute 23 and expands through the turbine into output chamber or volute 25, to drive compressor 22. The fluid vapor from evaporator 15 enters the compressor 22 through volute 24, and is compressed into the same output chamber or volute 25. The output of the mixing chamber 25 feeds into the condenser 13. In addition to utilizing a single output chamber, the turbocompressor 20 utilizes a single rotor.

Figure 3:
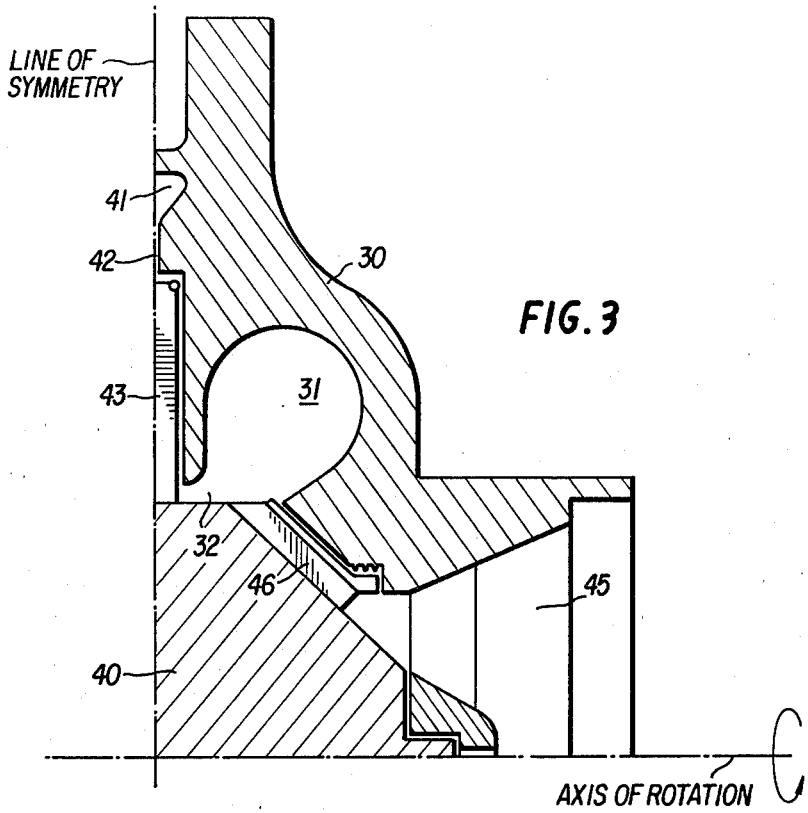
FIG. 3 is a one quarter sectional view of an integral turbine/compressor for use in the system of FIG. 2.

One illustrative form of integrated rotary turbocompressor is shown in FIG. 3. The stator of the unit is designated by the numeral 30, and the rotor by the numeral 40. The single output or exit chamber for the unit is formed by the stator and designated by the numeral 31. The high pressure vapor input to the unit, receiving the output from boiler 11 in FIG. 2, is indicated by the input volute or manifold 41. This high pressure vapor passes from the manifold 41 through a circumferentially arranged nozzle structure 42 to impinge upon the centripetal impellers or turbine blades 43 on hub 40, and then pass radially inwardly to the inner location of these blades and thence into the exit chamber 31. The compressor section of the unit is located on the rotational hub 40 radially inwardly of the turbine unit and chamber 31, and comprises the intake volute 45 and centrifugal impellers or blades 46. The turbine section rotationally drives the hub 40, which in turn drives the compressor blades 46. The fluid vapor output of evaporator 15 (FIG. 2) is thus fed to the compressor via intake 45, compressed by the action of blades 46, and is driven radially outwardly by said blades 46 to be delivered into the mixing chamber 31. Both the turbine fluid and the compressor fluid enter the mixing chamber 31 at substantially contiguous locations and at substantially the same radius on the hub or rotor 40, as indicated by point 32.

In operation of this integrated turbocompressor, both the centripetal flow of the turbine fluid and the centrifugal flow of the compressor fluid enter the chamber 31 at a speed just below hub speed at the radius designated by numeral 32. The swirl velocity of both flows is the same as both flows leave the rotor and enter the chamber 31. If a working fluid which condenses on expansion is used, such as water, then the turbine vapor entering chamber 31 is wet. For all practical fluids, compressor flow entering chamber 31 is superheated. Mixing these flows has a two-fold advantage—it reduces the superheat in the compressor flow, while simultaneously reducing the wetness of the turbine flow. Both of these factors contribute to a higher pressure recovery as the fluids undergo a transition from the outlet swirl velocity in chamber 31 to a velocity corresponding to flow in a pipe.

The overall effect of using an integrated turbocompressor such as indicated in FIGS. 2 and 3, as compared with separate turbine/compressor units as indicated by the prior art configuration of FIG. 1, is that the condenser in the system of FIG. 2 operates at a higher temperature than that for the FIG. 1 system, all other parameters being equal. If one operates both the FIG. 1 and FIG. 2 systems at the same boiler temperature (e.g. 300° F. with water as the working fluid) and the same evaporator temperature (e.g. 88° F.), one obtains a higher temperature for the FIG. 2 system condenser (e.g. 123.4° F.) than for that of the FIG. 1 system (e.g. 110° F.). As a result, the coefficient of performance (cooling load/boiler load) is 2.94 for FIG. 2 and 2.28 for FIG. 1, resulting in a Carnot efficiency (actual C.O.P./-Carnot C.O.P. percent) of 82% for FIG. 2, as compared with 37% for FIG. 1.

Figure 4:
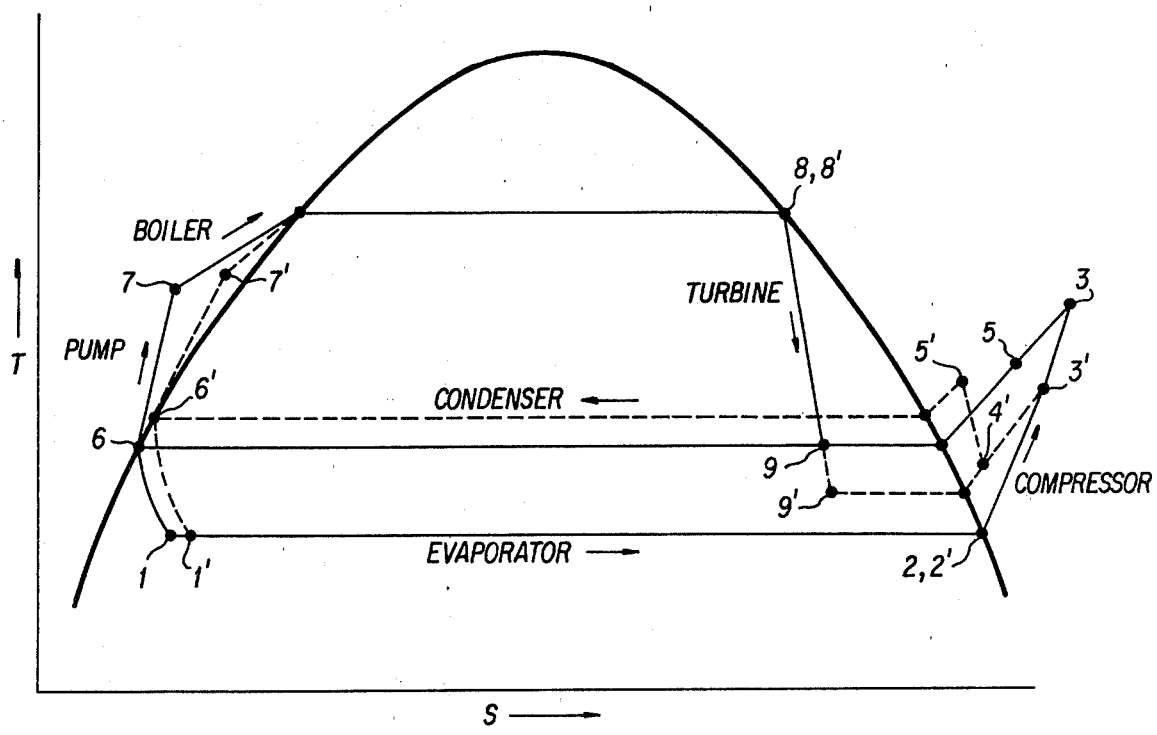
FIG. 4 is a temperature-entropy diagram showing the improved efficiency of the system of FIG. 2 over the system of FIG. 1.

The comparative operations of the FIG. 1 and FIG. 2 systems is qualitatively presented in the temperature-entropy diagram of FIG. 4. The significant points on this diagram as numbered 1 through 9, and those numbers relating to operation of a FIG. 1 system are unprimed, while those relating to a FIG. 2 system are primed. Operation of the FIG. 1 system is diagramed in solid lines, while deviations therefrom in operation of the FIG. 2 system are diagramed in dashed lines. Points 1 and 1' designate entry of the working fluid into the evaporator, while points 2 and 2' designate the working fluid leaving the evaporator as saturated vapor. Point 3 represents the fluid leaving the compressor 16. Point 3' is the fluid worked on by compressor 22, but prior to mixing in chamber 31 (FIG. 3). At 4', the turbine and compressor vapors are mixed in chamber 31. Point 5 represents the mixed outputs of turbine and compressor in FIG. 1, and entering the condenser 13; while point 5' represents the fluid entering condenser 13 in FIG. 2. Points 6 and 6' represent the state of the fluid leaving the condenser, respectively for FIG. 1 and FIG. 2. Points 7 and 7' indicate the state of the fluid after being pumped to the boiler, and point 8,8' represents the fluid issuing from the boiler, respectively in FIG. 1 and FIG. 2. Point 9 represents the fluid leaving the turbine 12 (FIG. 1); while point 9' represents the fluid exiting from turbine 21 (FIG. 2) just prior to mixing in chamber 31.

The diagram of FIG. 4 illustrates that when utilizing an integrated turbocompressor such as illustrated in FIGS. 2 and 3 pursuant to the teachings of the present invention, the operating temperature for the condenser is higher than when the separate outputs of the turbine and compressor are later combined, as in the prior art exemplified in FIG. 1. Because of this relationship, significantly higher efficiency is obtainable from single fluid heat pump systems.

It is understood that the specific embodiment herein described is presented as the preferred embodiment and best mode for practicing the invention as currently viewed by the inventor. However, other embodiments will be apparent to those skilled in the art, and such as are embraced by the spirit and scope of the appended claims are contemplated as being within the purview of the invention.

What is claimed is:

1. In a single working fluid heat pump system having a first subsystem with means for heating the fluid from a liquid to a vapor under pressure and a fluid motor driven by expansion of said vapor, a second subsystem with means for evaporating said fluid from a liquid to vapor and a compressor driven by said motor for compressing the fluid vapor from said evaporating means, and a condenser common to both subsystems for condensing the combined expanded fluid vapor output of said motor and the compressed fluid vapor output of said compressor to a liquid, the improvement wherein said motor and compressor are combined in a single integrated unit having one input to said motor, another input to said compressor, and a single output chamber therefor for mixing the expanded motor driving vapor with the compressed compressor vapor.

2. In a heat pump system as set forth in claim 1, said integrated motor and compressor unit being a rotary turbocompressor.

3. In a heat pump system as set forth in claim 2, one of said motor and compressor being a centrifugal device and the other being a centripetal device.

4. In a heat pump system as set forth in claim 3, said motor and compressor both discharging the working fluid therein at substantially contiguous locations into said single output mixing chamber.

5. In a heat pump system as set forth in claim 4, said motor and compressor being on the same rotational hub, and one of said motor and compressor being located radially outward of said discharge locations and the other being located radially inward of said discharge locations.

6. In a heat pump system as set forth in claim 2, said motor providing for centripetal flow of the working fluid therein, and said compressor providing for centrifugal flow of the working fluid therein.

7. In a heat pump system as set forth in claim 6, said motor and compressor both discharging the working fluid therein at substantially contiguous locations into a single mixing chamber.

* * * * *